United States Patent [19]

Eskeli

[11] Patent Number: 4,574,592

[45] Date of Patent: Mar. 11, 1986

[54] HEAT PUMP WITH LIQUID-GAS WORKING FLUID

[76] Inventor: Michael Eskeli, 10332 Desdemona, Dallas, Tex. 75228

[21] Appl. No.: 569,565

[22] Filed: Jan. 9, 1984

[51] Int. Cl.[4] ..... F25B 1/00

[52] U.S. Cl. ..... 62/114; 60/509; 62/502; 62/498

[58] Field of Search ..... 62/114, 84, 470, 498, 62/502; 60/509, 511, 512, 643; 237/12.1

[56] References Cited

U.S. PATENT DOCUMENTS 3,768,273 10/1973 Missimer ..... 62/114 X 3,872,682 3/1975 Shook ..... 62/114

*Primary Examiner*—Henry Bennett

[57] ABSTRACT

A method and apparatus for the pumping of heat wherein a working fluid is alternately compressed and expanded in a machine, and which usually provides for heat removal after the compression. The working fluid is a gas-liquid mixture comprising usually a gas such as argon and a liquid such as light oil, with such fluid mixture circulating within the machine both during compression and expansion. Normal uses for this machine are home heating and other heating uses.

5 Claims, 4 Drawing Figures

HEAT PUMP WITH LIQUID-GAS WORKING FLUID

This invention relates generally to heat pump work cycles and methods for generating heat wherein a working fluid is alternately compressed and expanded and the working fluid heated during such compression.

It is an object of this invention to provide a heat pump of improved efficiency and improved performance, and a heat pump of ease of operation and a unit of reduced cost of manufacture.

DESCRIPTION OF PREFERRED EMBODIMENTS

The intent of the heat pump disclosed herein is to provide for the compression of a gaseous working fluid with cooling, and for the expansion of the same fluid with heating. Also, a preferred method to provide for the cooling and heating is with a liquid fluid mixed with the gas and circulated together with the gas both during the compression and during the expansion. This type operation then eliminates the need for a circulating pump for the liquid, and eliminates the need for a liquid separator and liquid addition means, thus greatly simplifying the needed apparatus. The cooling of the gaseous working fluid reduces the amount of work required to compress the working fluid, as compared to isentropic compression, and the heating of the gas during expansion increases the work output by the working fluid; both contributing to an improved coefficient of performance, for the heat pump. Both the compressor, and the expander are positive displacement machines and the thermodynamic processes are of the internal energy type for the compression and for the expansion, usually.

Figure 1:
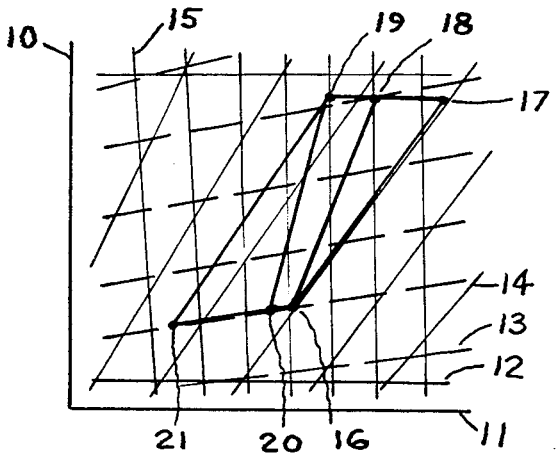
FIG. 1 is a pressure-internal energy diagram for illustrating the preferred work cycle for the heat pump.

Referring to FIG. 1, therein is shown a pressure-internal energy diagram for a typical gaseous working fluid, with a work cycle shown thereon for the heat pump. In the diagram, 10 is the pressure line and 11 is the internal energy line, 15 are constant temperature lines, 12 are constant pressure lines, 13 are constant volume lines, 14 are constant entropy lines, the actual work cycle performed by the gas is approximately shown by 16-18-19-20-16, noting that without the liquid present, the gas work cycle would be 16-17-19-21-16, and thus line 17-18 represents the cooling of the gas by the liquid during compression, and line 21–20 represents the heating of the gas during expansion. Heat removal in a heat exchanger is represented by line 18–19, and heat addition in a heat exchanger is represented by line 20–16. It also should be noted that lines 16–18 and 19–20 can be arranged to coincide at points 20 and 16, thus eliminating the need for the heat addition between points 20 and 16. Further, the heat addition between points 20–16 and the heat removal between points 18–19, may be at a constant pressure, or be at a constant volume as desired and whichever is the most advantageous for performance.

Figure 2:
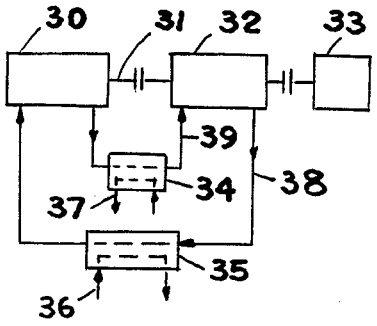
FIG. 2 is a schematic diagram for the apparatus to perform the work cycle of FIG. 1.

In FIG. 2, a schematic equipment diagram is shown for the heat pump process shown in FIG. 1, and 30 is a compressor, 31 is a connecting shaft, 32 is an expander, 33 is a drive unit, 34 is a heat removal heat exchanger, 35 is a heat addition heat exchanger, 36 and 37 are fluid lines for transferring heat, and 38 and 39 are working fluid mixture lines. As noted hereinbefore, need for heat exchanger 35 is optional.

Figure 3:
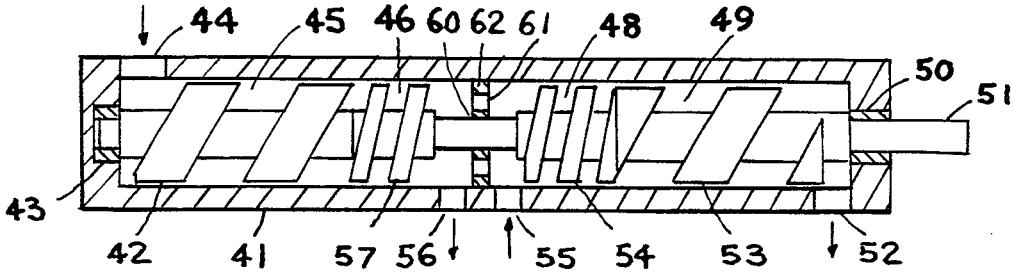
FIG. 3 is a cross section of a screw type compressor-expander suitable for use to perform the work cycle processes of compression and expansion of FIG. 1.

In FIG. 3, a cross section of a typical screw type compressor-expander unit is shown, and this unit is suitable for use with a liquid-gas mixture working fluid. In the figure, 41 is housing, 42 and 57 are a compression rotor formed from two separate pitched sections, 43, 60 and 50 are rotor shaft bearings, 44 is a fluid mixture inlet, 45, 46, 48 and 49 indicate fluid spaces between the rotor lobes 42,57,54 and 53, 56 is a fluid outlet from the compressor section, 55 is a fluid inlet into the expander section, 52 is a fluid mixture outlet from the expander section, 51 is a shaft, and openings 61 may be provided to allow a part of the working fluid mixture to pass from the compressor section to the expander section thus reducing the flow through openings 56 and 55. Generally, the rotors for this type machine are constructed from differently pitched sections mounted on the rotor shafts. Item 62 is a bearing support, usually inserted into the housing together with the rotors.

Figure 4:
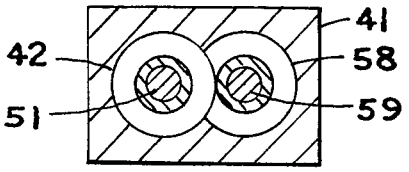
FIG. 4 is a cross section of the unit of FIG. 3.

In FIG. 4, a cross section of the unit of FIG. 3 is shown, and 41 is the housing, 42 and 58 are rotors, and 51 and 59 are rotor shafts.

In operation, the system is provided with the desired working fluid mixture, and the compressor and the expander are driven at the desired speed. The fluid mix is compressed in the compressor with a temperature increase, heat is removed from the fluid mix in the heat removal heat exchanger, the fluid mix is then passed through the expander where the fluid mix pressure and temperature are reduced, and then the fluid mix may be passed through a heat addition heat exchanger for the addition of heat.

In some instances, the heat exchanger 35 may become a second heat addition heat exchanger; this occurs when the points 18–19 of FIG. 1 are close and line 19–20 crosses line 16–18 in FIG. 1.

The fluids that form the fluid mixture are a gas, such as nitrogen, air, or argon. The liquid may be a light oil, water with suitable additives, or some other liquid. The amount of liquid in the gas is determined from the amount of cooling desired during compression, and since the same liquid also circulates during expansion with the gas, heat is added into the gas in similar amount as was removed from the gas during compression. Generally, the temperature change for line 17–18 and for line 21–20 is nearly the same, and lines 16–18 and 19–20 on the pressure-internal energy diagram are nearly parallel and are usually near each other. Generally, where this heat pump is used for home heating, the compression the gas would be from 0 F. to 200 F. without the liquid, corresponding to line 16–17, and with the liqud present the gas temperature is from 0 F. to 120 F., and then the gas-liquid mixture is cooled to appr. 70 F., after which the fluid mixture is expanded to a temperature below 0 F. Typically, the amount of oil in gas in the fluid mixture may vary from 0.13 to 0.5 lbs oil per pound of gas; the amount varies depending of the density and the properties of the gas.

The primary reasons for the use of the liquid-gas mixture as the working fluid are improved performance of the heat pump, that is, a higher Coefficient of Performance, and the cost of equipment. The two lines, 16–18 and 19–20 in FIG. 1 are normally fairly near each other, and this means that the work of compression and the work of expansion are also close, thus leading to a high COP value. Also, the use of the fluid mixture both during compression and during expansion elimnates the need for liquid separators and liquid-to-gas addition means that are normally needed when the liquid is separated from the gas; also, the need for a circulation pump for the liquid is eliminated that is sometimes used. Thus, the construction of the apparatus is much simpler.

The work processes hereinbefore are indicated to be non-flow, internal energy type; the processes may also be steady flow, enthalpy type if desired. Note that axial flow turbines normally can not be used due to erosion by the liquid present in the working fluid mixture. Also, the use of piston machines is limited due to liquid slugging in the cylinders.

In normal usage, where the fluid mixture is a gas-light oil, the oil forms a foam surrounding the gas in small bubbles; this ensures a high degree of heat transfer between the gas and the oil. Thus, the temperature of the gas and the oil are approximately equal at all points. The foaming of the oil also helps to circulate better the liquid with the gas, since the working fluid mixture is nearly a homogeneous one.

Reference is made to my earlier U.S. Pat. No. 4,050,253, and to a co-pending patent application No. 06/321,919, filed 11/16/81, "Heat Pump Machine and Method".

I claim:

1. A thermodynamic method of pumping heat comprising:

a. compressing a working fluid with accompanying pressure and temperature increase and the use of work;

b. removing heat from said working fluid downstream of the compression;

c. expanding said working fluid with accompanying (temperature and) pressure reduction and the recovery of work subsequent to the heat removal;

d. providing as said working fluid a fluid mixture comprising a compressible gas and a liquid where said gas and liquid are different fluids, and wherein the function of said liquid is to cool said gas during compression and to heat said gas during expansion, and further, wherein approximately the same fluid mixture passes passes through the expansion and compression steps, and also, wherein the amount of liquid in the gas-liquid mixture is less than what is required to maintain a constant fluid temperature during compression thus providing for the temperature increase during the compression;

e. providing a non-flow positive displacement process for said working fluid during the compression and expansion steps.

2. The method of pumping heat of claim 1 wherein a heat exchanger for heat transfer is provided for said working fluid downstream of the expansion step, to provide an approximately constant temperature for said fluid prior to start of compression.

3. The method of pumping heat of claim 1 wherein the said compressible gas is argon.

4. The method of pumping heat of claim 1 wherein the said fluid mixture circulates through the compressing and expanding and heat exchange means in a closed loop and wherein the working fluid lowest pressure within the loop is higher than atmospheric pressure.

5. The method of claim 1 wherein said liquid in the working fluid mixture is a liquid that forms a foam when circulated within the heat pumping apparatus.

* * * * *